US006640440B1

(12) United States Patent
Chan

(10) Patent No.: US 6,640,440 B1
(45) Date of Patent: Nov. 4, 2003

(54) ADJUSTABLE HEAD FOR AN ELECTRICAL CLIPPER

(76) Inventor: Te-Fa Chan, 5F-2, No. 96, Sec. 3, Mu-Cha Rd., Taipei (TW)

( * ) Notice: Subject to any disclaimer, the term of this patent is extended or adjusted under 35 U.S.C. 154(b) by 28 days.

(21) Appl. No.: 10/137,318

(22) Filed: May 3, 2002

(51) Int. Cl.[7] ..... B26B 19/20
(52) U.S. Cl. ..... 30/201; 30/233.5
(58) Field of Search ..... 30/200, 201, 233, 30/233.5

(56) References Cited

U.S. PATENT DOCUMENTS 4,622,745 A * 11/1986 Wahl ..... 30/201
5,050,305 A * 9/1991 Baker et al. ..... 30/201
5,060,380 A * 10/1991 Fujikawa ..... 30/200
5,327,648 A * 7/1994 Ullmann ..... 30/200
6,044,558 A * 4/2000 Wu ..... 30/223.5

* cited by examiner

*Primary Examiner*—Hwei-Siu Payer
(74) *Attorney, Agent, or Firm*—Rosenberg, Klein & Lee

(57) ABSTRACT

An adjustable head adapted to an electrical clipper has an engaging port adapted to be securely attached to a side face of a body of the electrical clipper. A trough is defined in the engaging port and cutouts are oppositely defined in two inner side faces of the engaging port. A connecting head is detachably received in the engaging port. The connecting head has a base with two protrusions oppositely formed on two side faces of the connecting head to correspond to the cutouts in the two tracks. Two slits are each defined adjacent to a corresponding one of the two protrusions to provide resilience to the corresponding protrusion and a hollow receiving port is formed on a side of the base. The receiving port is adapted to correspond to teeth of the electrical clipper and has through holes defined in a top face of the receiving port.

2 Claims, 3 Drawing Sheets

ADJUSTABLE HEAD FOR AN ELECTRICAL CLIPPER

BACKGROUND OF THE INVENTION

1. Field of the Invention

The present invention relates to an adjustable head for an electrical clipper, and more particularly to an adjustable head movably attached to the electrical clipper so that the user is able to adjust the position of the adjustable head relative to the electrical clipper to achieve the purpose of varying the length of the hair being cut.

2. Description of Related Art

Nowadays, more and more people use electrical clippers to trim their hair to save money. The conventional electrical clipper has different clipping heads each detachably connected to the body of the electrical clipper and having through holes with different lengths. With the clipping heads, the user is able to trim the hair as desired. That is, when the user wants to trim the hair short, the user may choose the clipping head with the deepest length. Because the length of the chosen clipping head is deep, the quantity and length of hair extending into the through holes is large and long, such that after trimming the hair with the chosen clipping head, the length of the remaining hair is short. Although this kind of electrical clipper does have the function of trimming the hair with different lengths, drawbacks still exist.

Because the electrical clipper needs multiple clipping heads each with a specific dimension to fulfill requirements, users will have constantly change from one clipping head to another, which is quite inconvenient for the user.

Different clipping heads mean different molds are required to make the heads so as to adapt to the body of the electrical clipper and fulfill the designated purpose. However, this will increase the cost for making and storage.

To overcome the shortcomings, the present invention tends to provide an improved adjustable head for an electrical clipper to mitigate and obviate the aforementioned problems.

SUMMARY OF THE INVENTION

The primary objective of the present invention is to provide an improved adjustable head movably connected to the body of the electrical clipper so that the user is able to randomly move the adjustable head relative to the body of the electrical clipper to trim the hair to different lengths.

In order to accomplish the foregoing objective, the adjustable head is composed of an engaging port adapted to be securely attached to a side face of a body of the electrical clipper and having a substantially U shaped configuration. The engaging port defines a trough in the engaging port and two tracks are oppositely formed on the engaging port. Each track is provided with cutouts sequentially in a side face of the track and a connecting head is detachably received in the engaging port. The connecting head has a base with two protrusions oppositely formed on two side faces of the connecting head, two slits each defined adjacent to a corresponding one of the two protrusions to provide resilience to the corresponding protrusion and a hollow receiving port formed on a side of the base, which is adapted to correspond to the teeth of the electrical clipper. The receiving port is provided with through holes defined in a top face of the receiving port.

Other objects, advantages and novel features of the invention will become more apparent from the following detailed description when taken in conjunction with the accompanying drawings.

DETAILED DESCRIPTION OF THE PREFERRED EMBODIMENT

Figure 1:
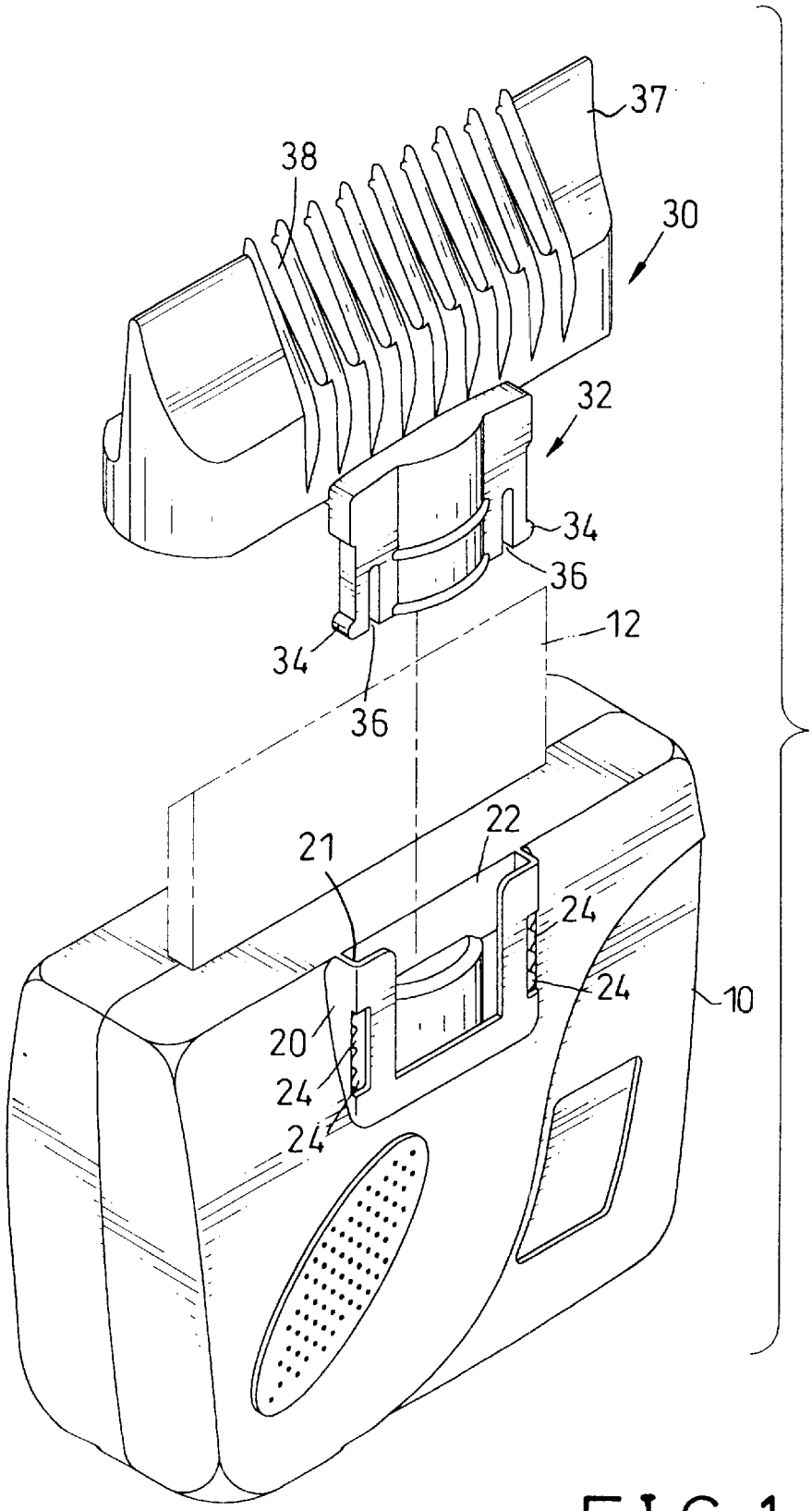
FIG. 1 is a perspective view of the adjustable head in combination of an electrical clipper.

With reference to FIG. 1, the adjustable head constructed in accordance with the present invention is composed of an engaging port (20) adapted to be securely attached to a side face of a body (10) of the electrical clipper and having a substantially U shaped configuration. The engaging port (20) defines a trough (22) in the engaging port (20) and two tracks (21) oppositely formed on the engaging port (20). Each track (21) is provided with cutouts (24) sequentially in an inner side face of the track (21).

A connecting head (30) is adjustably received in the engaging port (20) and having a base (32) with two protrusions (34) oppositely formed on two side faces of the base (32), two slits (36) each defined adjacent to a corresponding one of the two protrusions (34) to provide resilience to the corresponding protrusion (34) and a hollow receiving port (37) formed on a side of the base (32). The protrusions (34) are configured to be snappingly receivable in the corresponding cutouts (24). The receiving port (37) is adapted to correspond to the teeth of the electrical clipper and provided with through holes (38) defined in a top face of the receiving port (37).

Figure 2:
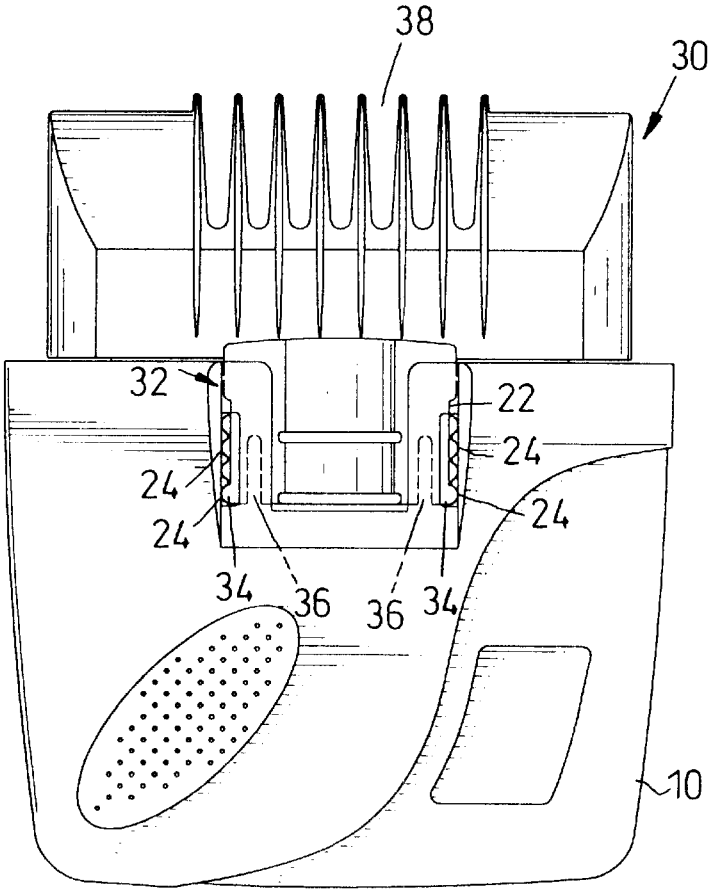
FIG. 2 is a side view showing the assembled electrical clipper with the adjustable head detachably mounted on top of the electrical clipper.
Figure 3:
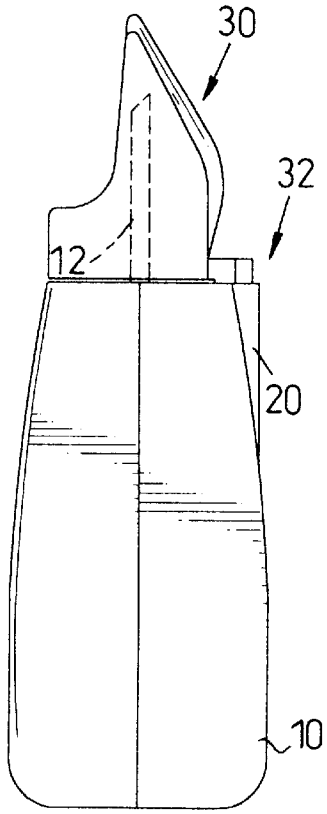
FIG. 3 is an end view of the combination in FIG. 2.

With reference to FIGS. 2 and 3, when the assembly between the body (10) and the adjustable head is required, the user may insert the base (32) into the trough (22). When the base (32) is inserted into the trough (22), the two protrusions (34) follow the two tracks (21) and due to the provision of the slits (36), the two protrusions (34) are able to be temporarily retained in a corresponding pair of cutouts (24). While the base (32) is received in the trough (22) of the engaging port (20), the receiving port (37) receives the teeth (12) of the electrical clipper.

Figure 4:
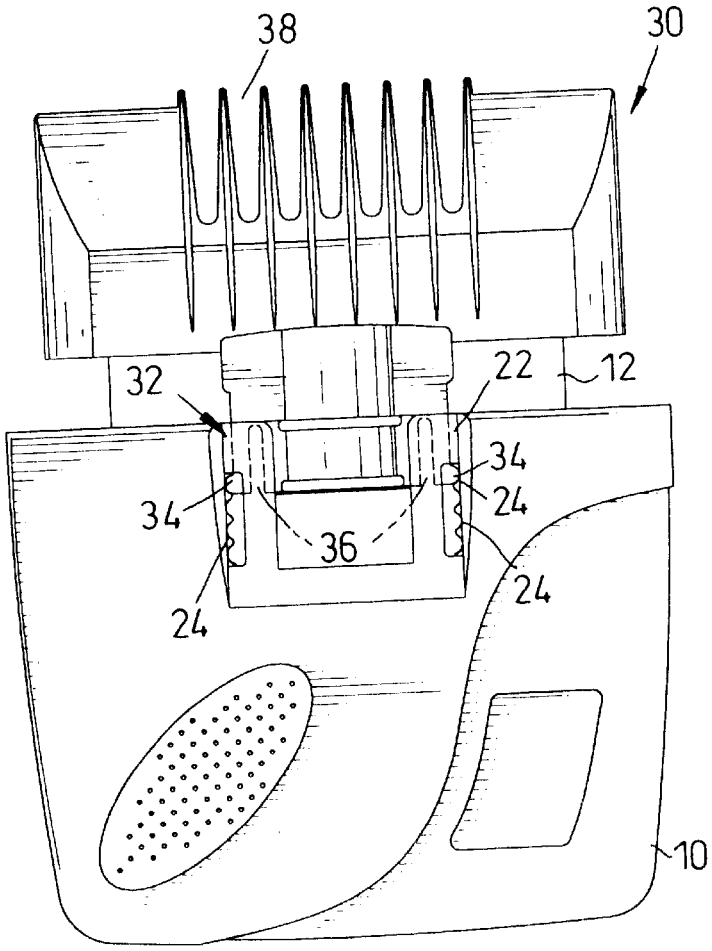
FIG. 4 is a side view showing the adjustment of the adjustable head relative to the body of the electrical clipper.
Figure 5:
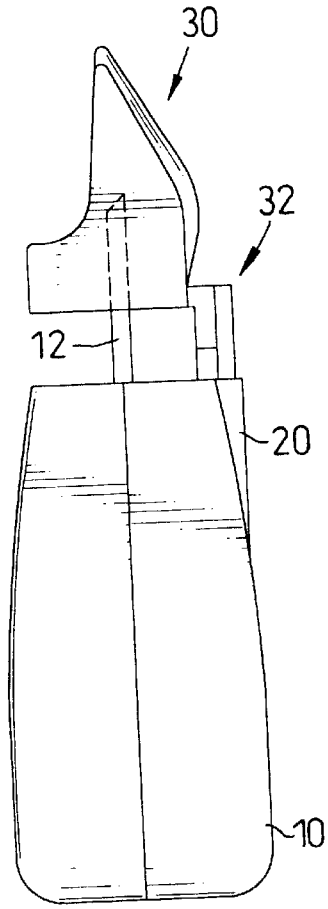
FIG. 5 is an end view showing the combination in FIG. 4.

When the user wants to change the position of the adjustable head, the user just presses or pulls the connecting head (30) to force the protrusions (34) to slide through the cutouts (24) until a required position is reached, as shown in FIGS. 4 and 5.

Because the adjustable head is movable relative to the teeth (12) of the electrical clipper, the user may change the position of the adjustable head with regard to the body (10) of the electrical clipper so as to accomplish the purpose of varying the length of the trimmed hair. Based on the feature, the user only needs one head to be adapted to the teeth of the body, so that the cost for making the entire electrical clipper is greatly reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adjustable head adapted to an electrical clipper, the adjustable head comprising:

an engaging port adapted to be securely attached to a side face of a body of the electrical clipper and having a substantially U shaped configuration, wherein the engaging port defines a trough in the engaging port and cutouts oppositely defined in two inner side faces of the engaging port; and a connecting head detachably received in the engaging port, wherein the connecting head has a base with two protrusions oppositely formed on two side faces of the connecting head to correspond to the cutouts in the engaging port, two slits each defined adjacent to a corresponding one of the two protrusions to provide resilience to the corresponding protrusion and a hollow receiving port formed on a side of the base, wherein the receiving port is adapted to correspond to teeth of the electrical clipper and has through holes defined in a top face of the receiving port, whereby slidable movement of the protrusions in the cutouts allows a position change of the adjustable head to the electrical clipper body and hair is able to extend into the through holes in the receiving port to be trimmed by the teeth of the electrical clipper.

2. The adjustable head as claimed in claim 1, wherein the engaging port has two tracks formed on two opposite sides of the engaging port, wherein on an inner side face of each track, the cutouts are defined.

* * * * *